US006267119B1

(12) United States Patent
Silva

(10) Patent No.: US 6,267,119 B1
(45) **Date of Patent: *Jul. 31, 2001**

(54) HAIRCUTTING GUIDE-COMB

(76) Inventor: David A. Silva, 632 Loma Prieta Dr., Aptos, CA (US) 95003

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/652,723

(22) Filed: May 22, 1996

Related U.S. Application Data

(63) Continuation-in-part of application No. 08/375,379, filed on Jan. 17, 1995, now abandoned.

(51) Int. Cl.[7] ..... A45D 24/34
(52) U.S. Cl. ..... 132/213; 132/213.1
(58) Field of Search ..... 132/213, 213.1, 132/214, 144, 148, 277, 273, 275, 276, 279

(56) References Cited

U.S. PATENT DOCUMENTS

| | | | | |
|---|---|---|---|---|
| 1,462,167 | * | 7/1923 | Crooms | 132/148 |
| 2,637,329 | * | 5/1953 | Reiter | 132/277 |
| 2,649,763 | * | 8/1953 | Buergi-Schenk | 132/144 |
| 3,057,366 | * | 10/1962 | Fink | 132/277 |
| 3,595,249 | * | 7/1971 | Solomon | 132/273 |
| 4,520,565 | * | 6/1985 | Maggiore | 132/214 |
| 5,022,350 | * | 6/1991 | Sequist | 132/148 |
| 5,520,201 | * | 5/1996 | Hart et al. | 132/277 |
| 5,533,533 | * | 7/1996 | Shing | 132/276 |
| 5,638,836 | * | 6/1997 | Yasuda | 132/279 |

FOREIGN PATENT DOCUMENTS

| | | | | |
|---|---|---|---|---|
| 530752 | * | 12/1940 | (GB) | 132/144 |
| 879148 | * | 10/1961 | (GB) | 132/277 |

* cited by examiner

*Primary Examiner*—Todd E. Manahan
(74) *Attorney, Agent, or Firm*—Thomas E. Schatzel; Law Offices of Thomas E. Schatzel, A Prof. Corp.

(57) ABSTRACT

A haircutting guide-comb instrument for use in cutting head hair of a human being and including a pair of elongated legs superimposed over one another to clasp hair of the human being in between said legs with a bias spring engaged about the terminal ends of the legs to urge them in engagement with one another and an anchor at the terminal ends securing the bias springs to both of the elongated legs.

17 Claims, 2 Drawing Sheets

HAIRCUTTING GUIDE-COMB

This application is a continuation-in-part of patent application Ser. No. 08/375,379, filed Jan. 17, 1995, abandoned.

BACKGROUND OF THE INVENTION

1. Field of the Invention

The present invention relates to haircutting accessories and more particularly to a haircutting guide-comb instrument.

2. Description of the Prior Art

Many people desire to stylize their hair, but prefer not to go to a professional hairdresser for such services. Consequently, such persons cut their own hair and commonly encountered undesirable results. In the alternative, such people do without a haircut which results in an ungroomed appearance and a tendency of the ends of the hair to split. When the split ends are not cut, over a period of time they continue to split up the hair shaft until the fragile hair breaks off, resulting in thin tattered ends and lack of hair growth.

Also, many people who stylize their hair with bangs, usually need a bang trim within a few weeks of getting a haircut. A visit to a hair stylist just to get the bangs shortened can be costly both time wise and monetarily.

SUMMARY OF THE PRESENT INVENTION

An object of the present invention is to provide an instrument which is convenient, practical and inexpensive for use in cutting an individual's hair.

A further object is to provide such an instrument that can be used by the individual cutting his or her own hair or by a professional hair stylist.

A further object is to provide haircutting guide instruments of ordinary and unordinary shapes and sizes which can clip to an individual's hair and enable a person unskilled in haircutting to achieve a neat, even and accurate haircut.

A further object is to provide a haircutting guide instrument which may be used unassisted by a person whose hair is to be cut or by a second individual.

A further object of the present invention is to provide a haircutting guide instrument which clamps to an individual's hair and holds the hair in place during unexpected movements of the individual's head during the cutting operation.

A further object of the present invention is to provide a haircutting guide instrument which serves as a useful tool for students of cosmetology to practice haircutting.

A further object of the present invention is to provide an instrument which is convenient and practical for use in cutting an individual's hair and to comb the hair into place.

A further object is to provide a haircutting guide instrument which is sanitary, easy to manufacture, readily transportable and readily storable.

A preferred embodiment of the haircutting guide-comb of the present invention includes a first elongated leg having a handle about one end and a clamping portion. The first leg includes a flat surface that when in place, faces a head of a human being, a first guide edge for guiding a haircutting instrument and a hair engaging surface opposite said flat surface with a plurality of comb-teeth projecting from said hair engaging surface. The instrument further includes a second elongated leg having a second handle about one end and a second clamping portion with said second clamping portion superposed over said first clamping portion and said second handle superposed over said first handle. A bias spring is engaged to the first and second elongated legs adjacent to said first and second handles and is secured to the first and second elongated legs. The bias spring constantly urges the first elongated leg towards the second elongated leg and provides for rotation of the first clamping portion relative to the second clamping portion in response to pressure applied to the first and/or second handles.

An advantage of the present invention is that it provides for a haircutting guide-comb instrument that may be used by an individual to avoid the need of a professional hair stylist.

Another advantage of the present invention is that it enables a person unskilled in hairdressing to achieve an accurate haircut done neatly and evenly.

A further advantage of the present invention is that its use enables a person to achieve a haircut on his or herself unassisted or on another person.

A further advantage of the present invention is that it provides a haircutting guide-comb instrument which is easy to manufacture, economical to manufacture and easy to assemble.

Another advantage of the present invention is that it provides a haircutting guide-comb instrument which may be clamped to the individual's hair and holds the person's hair in place while simultaneously providing a cutting edge and simultaneously combing the hair.

A further advantage of the present invention is that it provides a haircutting guide-comb instrument that holds an individual's hair in place during abrupt head movements by the individual.

These and other objects and advantages of the present invention will no doubt become obvious to those of ordinary skill in the art after having read the following detailed description of the preferred embodiments which are illustrated in the drawing figures.

IN THE DRAWINGS

DETAILED DESCRIPTION OF THE PREFERRED EMBODIMENT

Figure 1:
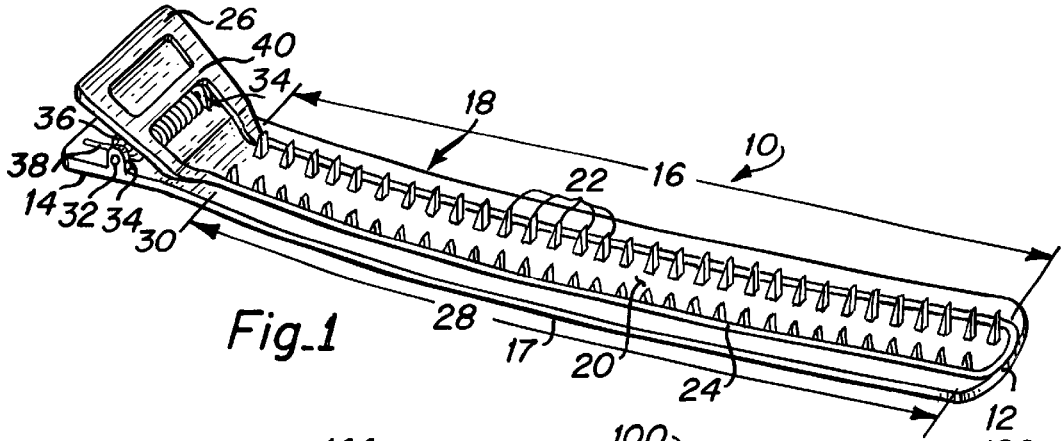
FIG. 1 is a perspective view of a first embodiment of a haircutting guide-comb instrument of the present invention.

FIG. 1 is a perspective view of a haircutting guide-comb instrument of the present invention and referred to by the general reference character 10. The haircutting guide-comb 10 includes a first planar elongated leg 12 having a handle 14 about one end and a clamping portion 16 projecting from the handle 14. The leg 12 has a flat planar surface portion 17 for placement facing the head of a human being whose hair is to be cut. The leg 12 further includes a guide edge 18 for guiding a haircutting instrument, e.g. scissors, clippers or other haircutting tools. The clamping portion 12 further includes a hair engaging surface 20 with a plurality of comb-teeth 22 projecting from the hair engaging surface 20. The teeth 22 provides for combing the person's hair. The haircutting guide-comb 10 further includes an elongated leg 24 in the form of a U-shaped wire that is connected to a handle 26 about one end and a clamping portion 28 projecting from the handle 26 and superimposed over the clamping portion 16 of the first elongated leg 12. Said handle portion 26 is superimposed over said handle portion 14.

A bias spring 30 is engaged to a common pivot hinge pin 32 extending coaxially through the bias spring 30. The pivot hinge pin 32 is anchored at each end by a pair of guide studs 34 projecting from the handle 14 to anchor the bias spring to the handle 14. Likewise, the pivot hinge pin 32 is further anchored at each end to a pair of studs 36 projecting from the handle 26. The studs 34 and 36 are superimposed over each other and coaxially with the pivot hinge pin 32. The bias spring 30 has a first terminal end 38 in frictional engagement with the interior surface of the handle 14 and a second terminal end 40 in frictional engagement with the interior surface of the handle 26. Thus, the bias spring 30 constantly urges the handles 26 and 14 apart thereby urging the elongated leg 24 towards the surface 20 such that when in use, the human being's hair within the teeth 22 are held in place. On the other hand, when it is desirable to separate the elongated member 24 from the surface 20, an individual merely grasps the handles 14 and 26 with the human being's fingers and urges the handles towards each other, thereby creating spacing between the surfaces 20 and 24.

Figure 2A:
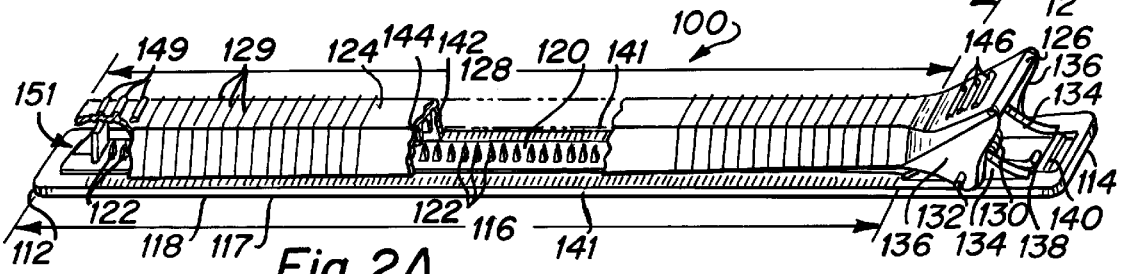
FIG. 2A is a perspective, partially sectioned view of a second embodiment of a haircutting guide-comb instrument of the present invention.

FIG. 2A is a perspective view of a further embodiment of a haircutting guide-comb instrument of the present invention and referred to by the general reference character 100. The haircutting guide-comb 100 includes a first elongated leg 112 with a handle 114 projecting from the end of leg 112. The elongated leg 112 includes a clamping portion 116 to engage the hair of an individual human being. One side of the clamping portion includes a flat surface portion 117 for placement facing the head of the individual and a guide edge 118 for guiding haircutting instruments, for example scissors, clippers, etc. The clamping portion 116 includes a hair engaging surface 120 with a plurality of comb-teeth 122 projecting therefrom for combing the individual's hair.

The haircutting guide-comb 100 further includes an elongated leg 124 superimposed over the elongated leg 112. A handle 126 projects from one end of the leg 124. The leg 124 includes a clamping portion 128 which is superposed to and coincides with the clamping portion 116. A plurality of ribs 129, forming straight line inscriptions are formed on and transversing the top surface of leg 124 for lining up with the hair of the individual to keep the guide-comb 100 in balance.

A bias spring 130 is engaged to the handle 114 by a pivot hinge pin 132 extending coaxially through the bias spring 130 and supported at its terminal ends by a pair of guide studs 134 projecting from the handle 114. The bias spring 130 is further engaged to the handle 126 by means of a pair of guide studs 136 projecting from the handle 126 with the terminal ends of the pivot hinge pin 132 extending through said guide studs. The guide studs 136 are superposed to the guide studs 134 with the pivot hinge pin 132 being coaxial with the studs 134, 136 and the bias spring 130. A first terminal end 138 of the bias spring 130 is anchored against the handle 114 and a second terminal end 140 of the bias spring 130 is anchored against the handle 126. As such, the bias spring 130 urges the handles 114 and 126 away from each other and thereby urges the elongated legs 112 and 124 against each other. To overcome such bias, an individual may hand grasp the handles 114 and 126 and urge them towards one another to thereby create spacing between the elongated legs 112 and 124. The elongated leg 112 further includes two rows of tongue and grooves 140 extending along the longitudinal edges. The elongated leg 124 also includes a pair of rows of tongue and grooves 142 which are superimposed over the rows of tongue and grooves 140 such that rows 141 and 142 have tendency to mesh with one another as legs 112 and 124 are urged together by the bias spring 130. As such, the tongue and grooves have a tendency to provide greater lateral stability and security of the haircutting guide-comb 100 when engaging the hair of a human being.

A central elongated channel 144 extends end-to-end of the clamping portion 128 of the elongated leg 124 and is positioned to overlap the line of teeth 120. The projection of the teeth 120 within the channel 144 provides further stability and security when the haircutting guide-comb 100 is in engagement with hair of an individual.

The handle 140 further includes a plurality of corrugations 146 extending laterally across the handle 126 and handle 114 to provide a frictional surface for hand engagement by the individual user. Likewise, a plurality of corrugations 149 extend laterally across the terminal end of the elongated legs 112 and 124 to further provide a frictional surface for hand engagement by the user. Further projecting from the terminal end of leg 112 is a guide stud 151 which is aligned with the terminal end of the channel 144 so as to provide guidance security of alignment of the legs 112 and 124 when in use.

Figure 2B:
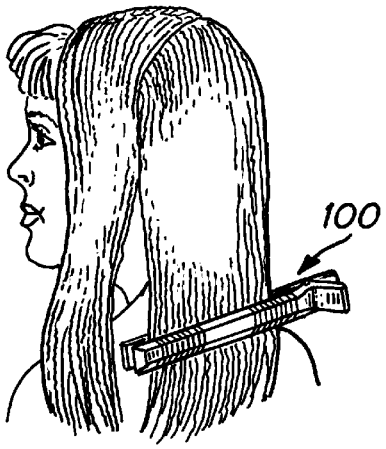
FIG. 2B is a perspective view of the haircutting guide-comb instrument of FIG. 2A placed in engagement with the hair of an individual in place for serving as a cutting guide.

FIG. 2B illustrates the haircutting guide-comb instrument 100 placed for use on an individual for providing a guide for cutting a straight line across a selected section of an individual human being's hair.

Figure 3A:
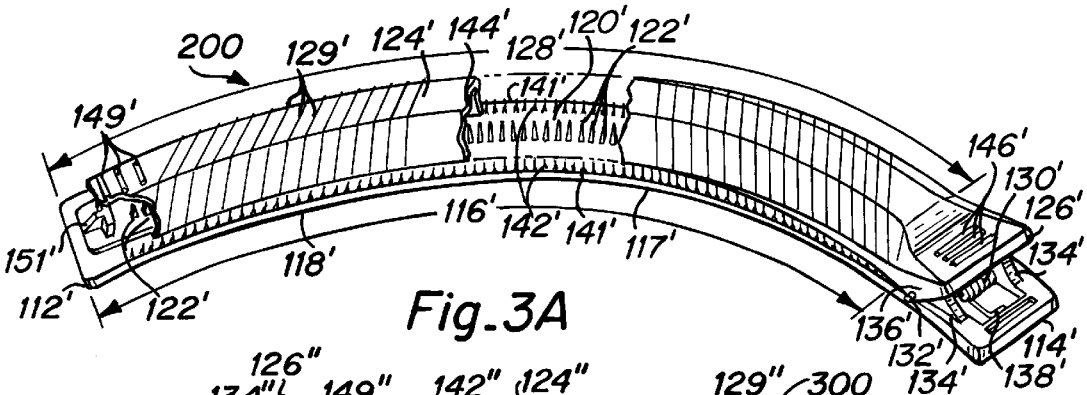
FIG. 3A is a perspective view of a modified version of the embodiment of FIG. 2A.

FIG. 3A illustrates a further embodiment of a haircutting guide-comb instrument of the present invention and referred to by the general reference character 200. The haircutting guide comb 200 is of similar structure to that of the haircutting guide-comb 100 except that it creates an arcuate cutting edge whereas the haircutting guide-comb 100 provides a straight cutting edge. Therefore, the elements of the haircutting guide-comb instrument 200 are the same as those for the haircutting guide-comb instrument 100 except that the elongated legs are arcuate. Therefore, all of the elements of instrument 200 similar to elements of instrument 100 carry the same reference numeral distinguished by a prime designation.

Figure 3B:
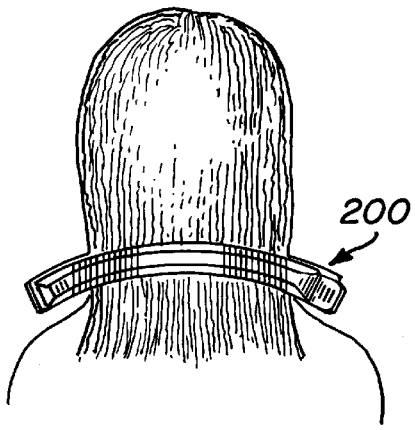
FIG. 3B is a perspective view of the haircutting guide-comb instrument of FIG. 3A placed in engagement with hair of an individual in place for serving as a cutting guide.

FIG. 3B illustrates the haircutting guide-comb instrument 200 as mounted on and engagement with the hair of an individual whose hair is to be stylized with an arcuate edge.

Figure 4A:
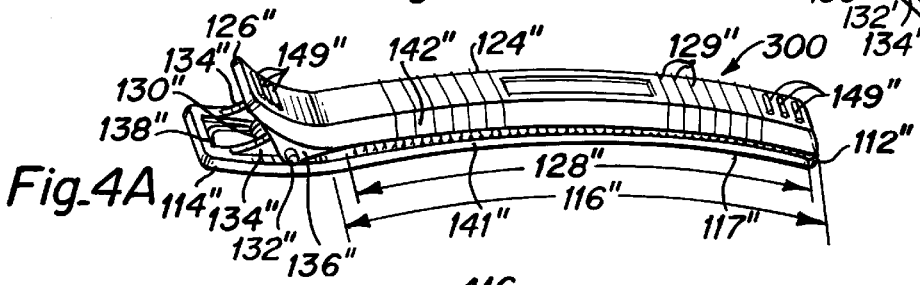
FIG. 4A is a perspective view of another embodiment of the present invention in the form of a haircutting guide-comb instrument for cutting straight bangs on an individual.
Figure 4B:
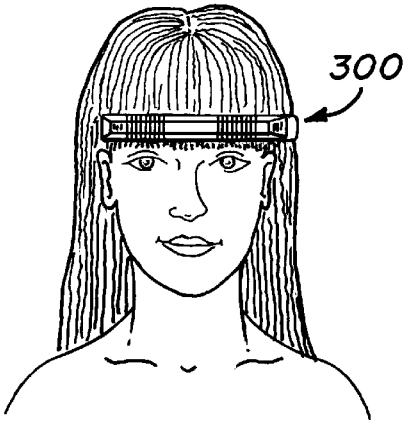
FIG. 4B is a perspective view of the embodiment of FIG. 4A placed in engagement with hair of an individual in place for serving as a cutting guide.

FIG. 4A illustrates a further embodiment of a haircutting guide-comb instrument of the present invention and referred to by the general reference character 300. The haircutting guide-comb 300 is similar in structure to the haircutting guide-comb 100 except that it is smaller and contoured for placement adjacent to the forehead of a user to be used for cutting straight bangs. As such, all elements of the haircutting guide-comb instrument 300 similar to those elements of the guide-comb 100 carry the same reference numeral distinguished by a double prime designation. The elongated legs 112" and 124" are contoured such that the flat surface 117" more closely resemble the shape of a forehead of a human being. FIG. 4B illustrates the use of the haircutting guide-comb instrument 300 for positioning for cutting the ends of the bangs in a straight line.

Figure 5A:
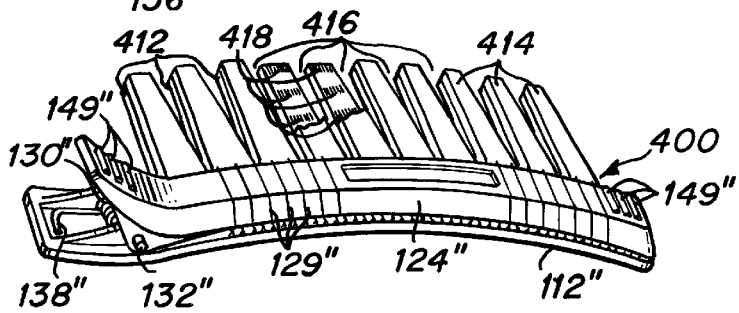
FIG. 5A is a perspective view of an embodiment of the haircutting guide-comb instrument of the present invention for use in forming serrated bangs.

FIG. 5A illustrates a further embodiment of a haircutting guide-comb instrument referred to by the general reference numeral 400 which is similar to the haircutting guide-comb 300, except that it further includes means for cutting serrations in the bangs of the hair of an individual. The structure of the haircutting guide-comb 400 is identical to that of the haircutting guide 300 with a plurality of serrations 412 projecting from the edge of the elongated leg 112". Likewise, there are a plurality of serrations 414 projecting from the edge of the elongated leg 124" with the serrations 412 and 414 superimposed relative to one another to form a plurality of V-shaped grooves 416 with the edges of the serrations 412 and 414 providing the cutting guide edge. Each of the serrations 412 and 414 include a plurality of tongue and grooves 418 to provide a secure grasp of the individual's hair.

Figure 5B:
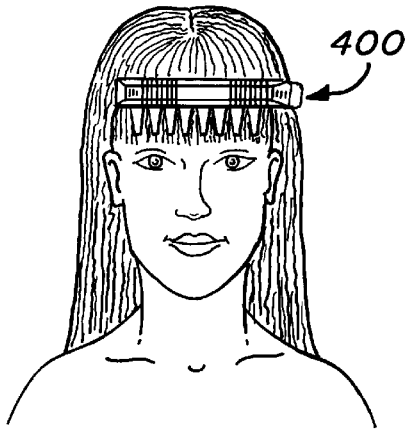
FIG. 5B is a perspective view of the embodiment of FIG. 4A placed in engagement the hair of an individual.

FIG. 5B illustrates the use of the haircutting guide-comb instrument 400 in place on an individual whereby the edges of the bangs can be cut to form a sawtooth configuration.

With the exception of the spring 30 and the pivot hinge pin 32, all of the components of the haircutting guide-comb instruments 100, 200, 300 and 400, may be made of plastic and as such may be injection molded. Thus, the components are very economical to make. Furthermore, there are essentially only four individual components, i.e. the elongated legs 112, elongated legs 124, spring 130 and pivot hinge pin 132. As such, the parts are very easy to assemble and without the need of any tools. Though the plastic material is preferable due to the cost, weight and ease of manufacture. However, the elongated legs may be constructed of metal.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A haircutting guide-comb instrument for use in cutting head pair of a human being comprising in combination:

a first elongated leg having a first handle about one end and a first clamping portion projecting from the first handle, the first leg having a flat surface for placement facing a head of said human being and a first guide edge for guiding a haircutting instrument and including a first tongue-and-groove configuration along said first guide edge, and a hair engaging surface elevated relative to said first guide edge and opposite said flat surface with a plurality of comb-teeth projecting from said hair engaging surface;

a second elongated leg having a second handle about one end and a second clamping portion with said second clamping portion superposed over said first clamping portion and said second handle superposed over said first handle, the second elongated leg including a second guide edge superposed to said first guide edge and a second tongue-and-groove configuration along said second guide edge superposed to said first tongue-and-groove configuration;

a bias spring engaged to the first and second elongated legs adjacent to said first and second handles; and a means for securing the bias spring to the first and second elongated legs and constantly urging the first elongated leg towards the second elongated leg and providing for rotation of said first clamping portion relative to said second clamping portion in response to pressure applied to said first and/or second handles.

2. The haircutting guide-comb instrument of claim 1 wherein, said first guide edge extends along a first longitudinal edge of the first elongated leg and the first elongated leg includes a third tongue-and-groove configuration along a second longitudinal edge; and the second elongated leg includes a fourth tongue-and-groove configuration along an edge superposed to said third tongue-and-groove configuration.

3. The haircutting guide-comb instrument of claim 2 wherein, the second elongated leg includes an elongated channel superposed to said plurality of comb-teeth to receive terminal ends of said teeth.

4. The haircutting guide-comb instrument of claim 3 wherein, the means for securing the bias spring includes a pivot hinge pin extending through the bias spring and anchored at opposite ends to said first and second handles.

5. The haircutting guide-comb instrument of claim 4 wherein, said first handle and said second handle each project radially from said pivot hinge and angularly spaced apart relative to each other.

6. The haircutting guide-comb instrument of claim 5 wherein, each of said first and second handles have corrugated surfaces for frictional hand engagement.

7. The haircutting guide-comb instrument of claim 6 wherein, the first elongated leg includes a guide stud projecting from said hair engaging surface at terminal end of said comb-teeth and in alignment with said elongated channel.

8. The haircutting guide-comb instrument of claim 7 wherein, said first and second guide edges are serrated.

9. The haircutting guide-comb instrument of claim 7 wherein, said first and second guide edges are arcuate.

10. The haircutting guide-comb instrument of claim 7 wherein, the first and second elongated legs are arcuate resembling curvature of said head.

11. The haircutting guide-comb instrument of claim 7 further including, a plurality of straight line transverse inscriptions on a top surface of the second elongated leg to line up with hair of said human being.

12. The haircutting guide-comb instrument of claim 1 further including, a plurality of straight line transverse inscriptions on a top surface of the second elongated leg to line up with hair of said human being.

13. A haircutting guide-comb instrument for use in cutting head hair of a human being comprising in combination:

a first elongated leg having a first handle about one end and a first clamping portion projecting from the first handle, the first leg having a first surface for placement facing a head of said human being and a first uniform guide edge for guiding a haircutting instrument, and a hair engaging surface opposite said first surface with a plurality of comb-teeth projecting from said hair engaging surface, each of said plurality of comb-teeth having free ends tapered throughout their free end in the direction transverse to the stroke direction;

a second elongated leg having a second handle about one end and a second clamping portion with said second clamping portion superposed over said first clamping portion and said second handle superposed over said first handle, and an elongated hollow channel superposed over said plurlity of comb-teeth;

a bias spring engaged to the first and second elongated legs adjacent to said first and second handles; and a means for securing the bias spring to the first and second elongated legs and constantly urging the first elongated leg towards the second elongated leg and providing for rotation of said first clamping portion relative to said second clamping portion in response to pressure applied to said first or second handles;

whereby said hair of said human being may be positioned intermediate the first and second elongated legs with said first and second legs clamped together, such that an edge of said channel of said second leg urges the strands of said hair against the inside surface of said first leg, and with said comb-teeth penetrating entirely through strands of said hair into said channel such that said hair is combed while in clamped position as said instrument is then moved through said hair to a disired position whereat said comb-teeth support said strands of said hair intermediate adjacent comb-teeth in a uniform position and said first guide edge establishes a guide for said haircutting instrument such that said hair may be cut to form a terminating ending of said hair which is common with said guide edge when said instrument is removed from said hair.

14. The haircutting guide-comb instrument of claim 13 wherein, the first elongated leg has a terminal end opposite said first handle with a plurality of corrugations to provide a functional surface for hand engagement; and the second enlongated leg has a terminal end opposite said second handle with a plurality of corrugations to provide a functional surface for hand engagement.

15. A haircutting guide-comb instrument for use in cutting head hair of a human being comprising in combination:

a first elongated leg having a first handle about one end and a first clamping portion projecting from the first handle, the first leg having a first surface for placement facing a head of said human being and a first uniform guide edge for guiding a haircutting instrument, and a hair engaging surface opposite said first surface with a plurality of comb-teeth projecting from said hair engaging surface, each of said plurality of comb-teeth having a free end tapered throughout their free end in the direction transverse to the stroke direction;

a second elongated leg having a second handle about one end and a second clamping portion with said second clamping portion superposed over said first clamping portion and said second handle superposed over said first handle, and elongated hollow channel superposed over said plurality of comb-teeth;

a means for securing the first and second elongated legs together and with the first leg superposed to the second leg and providing for rotation of said first clamping portion relative to said second clamping portion in response to pressure applied to said first or second handles;

whereby said hair of said human being may be positioned intermediate the first and second elongated legs with said first and second legs clamped together such that an edge of said channel of said second leg urges the strands of said hair against the inside surface of said first leg, and with said comb-teeth penetrating entirely through strands of said hair into said channel such that said hair is combed while in clamped position as said instrument is then moved through said hair to a desired position whereat said comb-teeth support said strands of said hair intermediate adjacent comb-teeth in a uniform position and said first guide edge establishes a guide for said haircutting instrument such that said hair may be cut to form a terminal ending of said hair which is common with said guide edge when said instrument is removed from said hair.

16. The haircutting guide-comb instrument of claim 15 wherein, the second elongated leg includes a second guide edge superposed to said first guide edge.

17. The haircutting guide-comb instrument of claim 15 wherein, the first elongated leg has a terminal end opposite said first handle with a plurality of corrugations to provide a functional surface for hand engagement; and the second elongated leg has a terminal end opposite said second handle with a plurality of corrugations to provide a functional surface for hand engagement.

* * * * *